United States Patent [19]

Kreuter et al.

[11] 4,402,802

[45] Sep. 6, 1983

[54] ELECTROLYTIC BATH FOR THE DEPOSITION OF RHODIUM COATINGS

[75] Inventors: Erika Kreuter; Werner Kuhn, both Rodenbach; Wolfgang Zilske, Hanau, all of Fed. Rep. of Germany

[73] Assignee: Dequssa Aktiengesellschaft, Frankfurt, Fed. Rep. of Germany

[21] Appl. No.: 339,310

[22] Filed: Jan. 15, 1982

[30] Foreign Application Priority Data

Jan. 15, 1981 [DE] Fed. Rep. of Germany ..... 31000997

[51] Int. Cl.[3] ..... C25D 3/52

[52] U.S. Cl. ..... 204/47

[58] Field of Search ..... 204/47, 43 N

[56] References Cited

U.S. PATENT DOCUMENTS 3,515,651 6/1970 Ohkubo ..... 204/47

FOREIGN PATENT DOCUMENTS 627264 3/1936 Fed. Rep. of Germany .
2242503 3/1973 Fed. Rep. of Germany .
2329578 1/1975 Fed. Rep. of Germany .
24131 of 0000 Japan ..... 204/47
553255 7/1974 Switzerland .

OTHER PUBLICATIONS

Wiesner et al., Further Studies in Heavy Rhodium Plating, Plating, vol. 43, 3/56, pp. 347–355.

*Primary Examiner*—G. L. Kaplan
*Assistant Examiner*—Nam X. Nguyen
*Attorney, Agent, or Firm*—Cushman, Darby & Cushman

[57] ABSTRACT

There is described an electrolytic bath for the deposition of haze-free glossy rhodium coatings which furnish a white gold-like tint and low tension flims. This bath in addition to rhodium sulfate or phosphate, sulfuric acid and/or phosphoric acid also contains a sulfonic acid, especially an aromatic sulfonic acid, as for example, phenolsulfonic acid.

13 Claims, No Drawings

ELECTROLYTIC BATH FOR THE DEPOSITION OF RHODIUM COATINGS

BACKGROUND OF THE INVENTION

The invention is directed to an electrolytic bath for the deposition of haze-free glossy rhodium coatings which consist essentially of rhodium sulfate or phosphate, sulfuric acid, and/or phosphoric acid.

For decorative rhodinizations, especially for overlaying white gold there are needed rhodium coatings which have a haze-free high gloss and an especially bright gray tint which is similar to the white-gold color. The film thickness of this coating is between 0.1 and 1μ.

For the deposition of electrolytic rhodium films there are chiefly used baths which contain phosphate or sulfate and sulfuric acid or phosphoric acid. If films having a thickness of more than 0.7 μm are deposited then it is not possible to deposit the required haze-free glossy coatings without further additives. Also it is only possibly with difficulty to reproducibly obtain the light gray tint of the film with the known baths, even if the necessary conditions in the production of the rhodium preparation are exactly observed.

Besides coatings from these bath exhibit high internal stress so that even at very thin films numerous cracks occur in the film. The corrosion protecting action of the rhodium film is greatly reduced thereby.

There are already known rhodium baths having various additives which are supposed to improve the mentioned disadvantageous properties of the deposited rhodium films. Metallic additives such as thallium (Swiss Pat. No. 553255) or copper (French Pat. No. 1577593) have the disadvantage that they are hight toxic or do not give the desired bright tints.

In the use of alkali metal chlorides, as well as $MgCl_2$ or $AlCl_3$ (German OS No. 2329578) some chlorine can form at the anode through which the use is made substantially more difficult. Besides it is difficult to produce constant deposition conditions through the continuous discharge of chloride.

The use of organic compounds in rhodium baths as a rule leads to films which to be sure can be glossy but which no longer exhibit the bright color.

Thus there is known a rhodium bath (German Pat. No. 627,264) which can contain benzoic acid, phenol solution and gelatin. Furthermore polybasic organic acids, e.g. glutaric acid are known as additives (German OS No. 2242503). However, rhodium films produced from these baths do not show the desired white gold color.

Therefore it was the problem of the present invention to find an electrolytic bath for the deposition of haze-free glossy rhodium coatings which consists essentially of rhodium sulfate or phosphate, sulfuric acid, and/or phosphoric acid and furnishes a white gold-like tint and films with low intonal stress.

SUMMARY OF THE INVENTION

The problem is solved according to the invention by additionally including a sulfonic acid in the rhodium bath. Preferably these baths contain an aromatic sulfonic acid.

Although organic compounds as a rule as additives to rhodium baths impair the bright color of the coating, it has been surprisingly proven that sulfonic, especially aromatic (or heteroaromatic) sulfonic acids, preferably phenolsulfonic acid, pyridine-3-sulfonic acid or naphthalene trisulfonic acid (e.g. naphthalene-1,3,6-trisulfonic acid), are extraordinarily stable in sulfonic acid or phosphoric acid baths and lead to very bright and glossy films which are low in tension so that there also can be deposited films having a thickness above 1 μm. There also can be used for this purpose alkylsulfonic acids having 1 to 7 carbon atoms such as ethanesulfonic acid, butane-4-sulfonic acid, methane sulfonic acid, heptane-7-sulfonic acid, hydroxy substituted alkylsulfonic acids, e.g. 2-hydroxyethanesulfonic acid or vinylsulfonic acid. Other sulfonic acids include benzene sulfonic acid, p-toluenesulfonic acid.

By the addition of a small amount, e.g. 0.5 to 10 g/l of a phosphonic acid, e.g. 1-hydroxyethane-1,1-diphosphonic acid and/or a stable wetting agent, e.g. 0.01 to 2 g/l of a wetting agent such as a fluorotenside e.g. potassium perfluoroctane sulfonate there is prevented a clinging of the hydrogen formed to the cathode, whereby there is still further improved the uniformity of the color and gloss on the total surface being rhodinized.

The baths of the invention advantageously contain 1–10 g/l of rhodium as the sulfate and/or phosphate. 20–200 g/l of sulfuric acid, phosphoric acid or a mixture of both acids and 0.1–5 g/l of the sulfonic acid, preferably an aromatic sulfonic acid. The bath can be operated at a current density of 0.5–5 A/dm$^2$ and a temperature up to 60° C. The solvent in the baths in the examples was water.

The composition can comprise, consist essentially of, or consist of the stated materials.

The invention is explained in more detail with reference to the following examples.

DETAILED DESCRIPTION

EXAMPLE 1

There was deposited a 0.5 μm thick rhodium film at 40° C. and a current density of 1 A/dm$^2$ from a rhodium bath which contained 2 g/l of rhodium as rhodium sulfate and 40 g/l of sulfuric acid. The film was milky-matte.

After addition of 0.5 g/l of a 65% aqueous phenol-4,-sulfonic acid solution the deposition was repeated under the same conditions. There was obtained a haze-free, glossy rhodium film having a very bright gray color which showed practically no gaps.

EXAMPLE 2

There was deposited a 0.2μ thick rhodium film at room temperature and a current density of 1 A/dm$^2$ from a rhodium bath which contained 5 g/l of rhodium as rhodium phosphate, 10 g/l of phosphoric acid and 60 g/l of sulfuric acid.

The film was glossy and showed a degree of light reflection of 0.716.

After addition of 1 g/l of pyridine-3-sulfonic acid the deposition was repeated. The degree of light relection had increased to 0.770.

The entire disclosure of German priority application P 3100947.2 is hereby incorporated by reference.

What is claimed is:

1. An electrolytic bath suitable for the deposition of haze-free, glossy rhodium coatings comprising rhodium sulfate, rhodium phosphate, or a mixture thereof, sulfuric acid, phosphoric acid or a mixture of sulfuric acid and phosphoric acid and a pyridine sulfonic acid.

2. An electrolytic bath according to claim 1 containing 1–10 g/l of rhodium as rhodium sulfate, rhodium phosphate, or a mixture of rhodium sulfate and rhodium phosphate, 20–200 g/l of sulfuric acid, phosphoric acid, or a mixture of both acids and 0.1–5 g/l of the pyridine sulfonic acid.

3. An electrolytic bath according to claim 2 including 0.5 to 10 g/l of a phosphonic acid.

4. An electrolytic bath according to claim 3 wherein the phosphonic acid is 1-hydroxyethane-1,1-diphosphonic acid.

5. An electrolytic bath according to claim 2 including 0.01 to 2 g/l of a wetting agent.

6. An electrolytic bath according to claim 5 including 0.5 to 10 g/l of a phosphonic acid.

7. An electrolytic bath according to claim 1 containing 0.1 to 5 g/l of pyridinesulfonic acid.

8. An electrolytic bath according to claim 7 wherein the pyridinesulfonic acid is pyridine-3 sulfonic acid.

9. An electrolytic bath according to claim 1 including 0.01 to 2 g/l of a wetting agent.

10. An electrolytic bath according to claim 9 wherein the wetting agent is fluorotenside.

11. An electrolytic bath according to claim 1 including 0.5 to 10 g/l of a phosphonic acid.

12. An electrolytic bath according to claim 11 wherein the phosphonic acid is 1-hydroxyethane-1,1-diphosphonic acid.

13. An electrolytic bath according to claim 11 wherein the wetting agent is fluorotenside.

* * * * *